United States Patent [19]

Krengel

[11] Patent Number: 4,603,807

[45] Date of Patent: Aug. 5, 1986

[54] MILL FOR ROLL FORMING A FLUTED TUBE

[75] Inventor: Theodore H. Krengel, Flossmoor, Ill.

[73] Assignee: Allied Tube & Conduit Corporation, Harvey, Ill.

[21] Appl. No.: 616,281

[22] Filed: Jun. 1, 1984

[51] Int. Cl.[4] ..... B23K 31/00

[52] U.S. Cl. ..... 228/152

[58] Field of Search ..... 228/152, 17.5, 17; 72/177; 118/DIG. 11

[56] References Cited

U.S. PATENT DOCUMENTS

| | | | |
|---|---|---|---|
| Re. 18,272 | 12/1931 | Frahm et al. . | |
| 1,605,828 | 11/1926 | Frahm . | |
| 1,645,434 | 10/1927 | Lindblom | 219/61.1 |
| 3,247,692 | 4/1966 | Davis | 72/49 |
| 3,263,321 | 8/1966 | Lombardi | 29/429 |
| 3,433,043 | 3/1969 | Vermeulen et al. | 72/176 |
| 3,566,643 | 4/1969 | Westerbarkey | 72/49 |
| 3,606,785 | 9/1971 | Olsson | 72/199 |
| 3,722,248 | 3/1973 | Brunken | 72/176 |
| 3,928,997 | 12/1975 | Laws | 72/178 |
| 3,940,962 | 3/1976 | Davis | 72/50 |
| 3,965,551 | 6/1976 | Ostrowski . | |
| 4,081,649 | 3/1978 | Tonkovich | 219/61.1 |
| 4,082,212 | 4/1978 | Headrick | 118/DIG. 11 |
| 4,142,663 | 3/1979 | Blatnik | 228/17 |
| 4,283,824 | 8/1981 | Schatz et al. | 29/157 |
| 4,391,117 | 7/1983 | Demny | 72/224 |

*Primary Examiner*—Nicholas P. Godici
*Assistant Examiner*—G. M. Reid
*Attorney, Agent, or Firm*—Fitch, Even, Tabin & Flannery

[57] ABSTRACT

A tubing mill for roll forming a strip of metal into a fluted tube having alternating longitudinally extending high and low portions on its outside surface. The mill includes feed means for supplying a generally planar strip of metal and embossing means for forming the high and low portions on the surface of the strip to be formed into the outside surface of the tube. The mill also includes breakdown means for sequentially transversely bending the strip from its planar condition. The breakdown means includes roller means having a gripping surface for engaging the strip and having alternating high and low portions shaped to mate with those of the strip. Additionally, the mill includes closure means for bringing into abutment the lateral ends of the bent portions of the strip, and welding means for seam welding the ends together.

6 Claims, 7 Drawing Figures

MILL FOR ROLL FORMING A FLUTED TUBE

BACKGROUND OF THE INVENTION

The present invention relates to apparatus for forming tubing and, more particularly, to a tubing mill for roll forming fluted tubing.

Fluted tubing has come into increasing commercial acceptance for uses such as in making fence posts. Not only does the fluted tube have qreater aesthetic appeal, it also offers increased strength compared to the conventional round tube. This occurs because the bends in the fluted tube afford it greater column strength and because the fluted tube is cold worked to a greater extent in its forming process.

One method of forming fluted or corrugated tubing includes first forming a tube of round cross section and then, as one of the last steps in the formation process, passing the round tubing through a set of turk's head rollers having working surfaces carrying the fluted pattern. It will be appreciated that since these patterned rollers can only engage the outside surface of the tubing, the degree of cold working of the tubing material is limited. For further information regarding this forming method and the apparatus used in carrying it out, reference may be made to U.S. Pat. No. 3,928,997.

In another proposed process for forming fluted tubing, an essentially conventional round tube continuous roll forming mill is used with the additional preliminary step that the flat strip is passed through embossing rolls to form the fluted pattern prior to transverse bending of the strip. This process has been found unsatisfactory because the pressure applied by the breakdown or bending rolls, needed to permit subsequent processing of the tubing, for example, applying a coating to the outside surface of the tubing, is so great that substantial flattening of the fluted pattern results.

SUMMARY OF THE INVENTION

Among the several objects of the improved roll forming tube mill of the present invention is the production of fluted tubing having sharply defined longitudinally extending plateaus and valleys on the outer tube surface. It is also an object to more completely cold work the strip metal to give it increased strength. The mill also permits coatings applied to the formed tubing sufficient curing time prior to the coated tubing portion engaging a mill component which otherwise would wipe off a part of an uncured coating thus denying a part of the tubing maximum corrosion protection or making it appear unsightly. The improved mill also has the objectives of reduced power consumption, increased reliability and service life, and economy of manufacture. Other objects and features of the present invention will be in part apparent and in part pointed out hereinafter in the following specification and claims as well as in the appended drawings.

Briefly, the tubing mill of the present invention includes feed means for supplying a generally planar strip of metal and embossing means for forming high and low portions on the surface of the strip. The mill further includes breakdown means for sequentially transversely bending the strip from its planar condition. Included in the breakdown means is roller means having a gripping surface for engaging the strip with the gripping surface provided with alternating high and low portions shaped to mate with to those of the strip. Additionally, the mill includes closure means for bringing into abutment the lateral ends of the bent portion of the strip and welding means for seam welding the lateral ends together to form the tubing.

As a method of forming a fluted tube from a generally planar metallic strip, the present invention includes the step of embossing alternating high and low longitudinally extending portions on the surface of the strip to become the outside surface of the tube. Next the embossed strip is sequentially transversely bent from its planar condition by applying pressure to opposite sides of the strip but without substantial flattening of the fluted pattern. After the lateral ends of the bent strip portion are brought into abutment, they are welded together.

BRIEF DESCRIPTION OF THE DRAWINGS

Corresponding reference characters indicate corresponding components throughout the several views of the drawings.

DESCRIPTION OF THE PREFERRED EMBODIMENT

Figure 1:
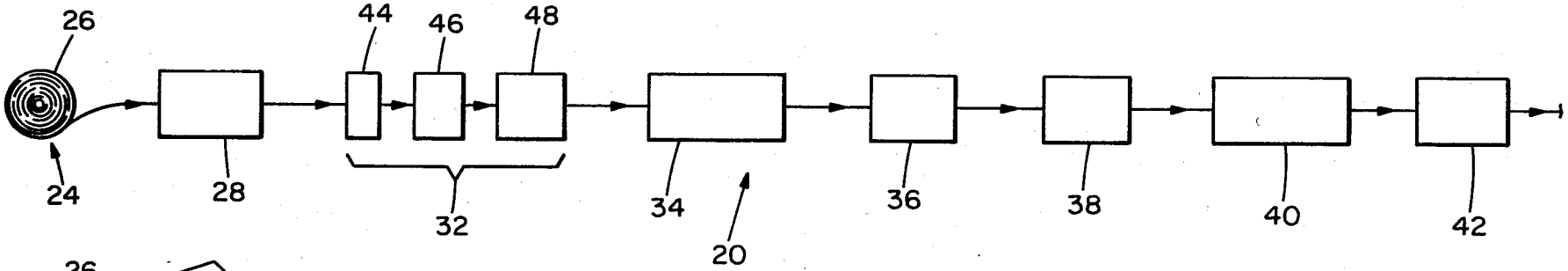
FIG. 1 is a block diagram of the components of the roll forming tube mill of the present invention.
Figure 7:
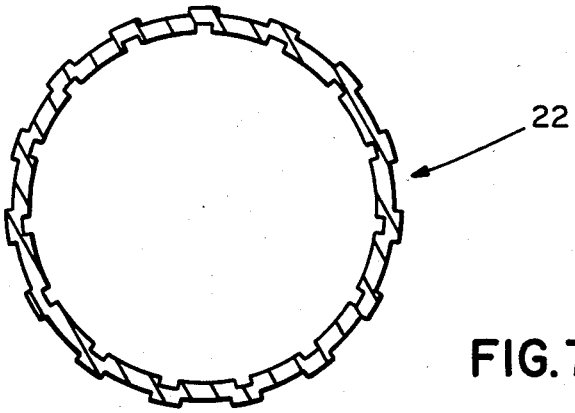
FIG. 7 is a cross-sectional view of a length of fluted tubing formed by the mill of FIG. 1.

Referring now to the drawings, a continuous roll form tube mill for forming fluted tubing 22 (best shown in FIG. 7) is generally indicated in FIG. 1 by reference character 20. The mill 20 functions to provide an embossed pattern of longitudinally extending alternating valleys and plateaus in a flat metal strip, bend the strip into a tubular form, generally circular in cross section but retaining the fluted pattern, and seam welding the abutting lateral ends together. The mill also operates to size the welded tubing to its final outside dimension, apply a coating (such as a lacquer) to the outside of the tube and cure the coating.

Figure 3:
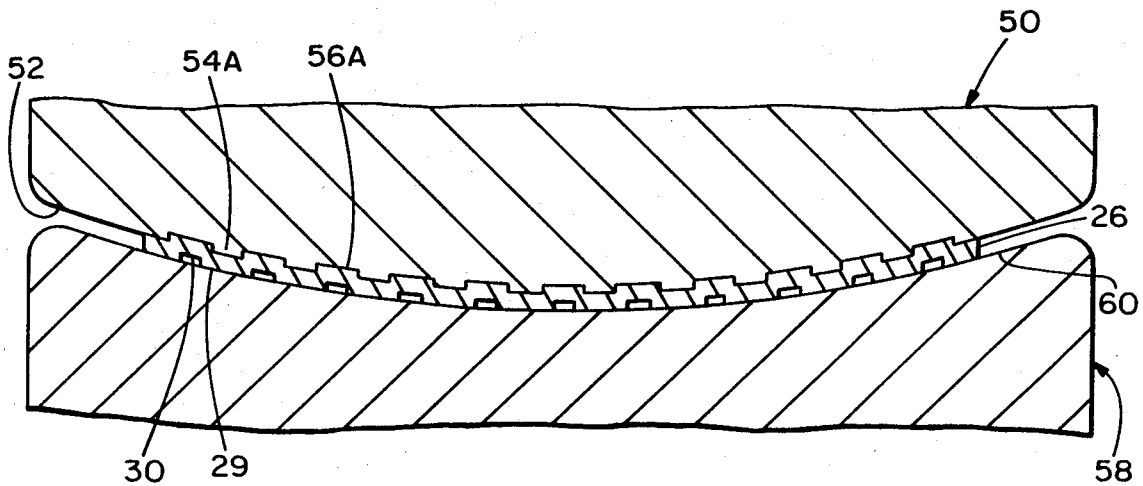
FIG. 3 is an enlarged sectional view depicting the strip compressively held between a first pair of rollers, with the upper roller of the pair having a gripping surface including alternating plateaus and valleys and a lower roller having a working surface facing the gripping surface.

More specifically, the mill 20 includes a feed station 24 for supplying an elongated steel strip 26. The strip, in coil form, is mounted on a pay out reel suitably rotatably supported at feed station 24. The strip 26 is received, in its flat form, at an embossing station 28 where it passes between a pair of driven embossing rolls with the annular ribs of one roll aligned with the annular grooves of the other roll to give the strip the fluted pattern of alternating longitudinally extending plateaus 29 and valleys 30 as shown in FIG. 3. The embossed strip is next received at a breakdown station 32 where the strip is sequentially transversely bent from its generally planar condition.

At a closure station 34, the incompletely transversely bent tubing is further bent causing the lateral ends of the strip to be brought together in abutting relationship. As is well known to those of skill in the art, the closure station 34 includes non-driven cluster and fin pass rollers. After the abutting ends are seam welded together at a welding station 36, the tubing advances to a sizing station 38 where driven rollers compressively engage it to insure satisfactory roundness and to give the tubing its final outside dimensions. The tubing next moves to a coating station 40 where, for example, a lacquer is applied to the tubing for corrosion protection or to make the tubing more aesthetically pleasing. At the coating station the tubing also undergoes application of heat and air to cure the coating. Next downstream is a helper station 42 where driven pinch rollers in the form of endless rubber belts apply tension to the tubing. These belts are further described in commonly assigned U.S. Pat. No. 3,965,551, the teachings of which are hereby incorporated by reference. Remaining components of the mill 20, such as a cutting station, where the tubing is severed into lengths, are not shown as they are well known to those of skill in the art.

The pinch rollers at the helper station cooperate with rollers at the breakdown station 32, as well as those at other stations, to hold the tubing and the strip from which it is formed under sufficient tension to prevent substantial sagging of the tubing in the area of the coating station. The complete mill may be over 200 feet in length and the distance from the area of the application of the lacquer to the helper station may be over 70 feet. During the tubing's travel over this last distance, it is necessary that the tubing be kept out of contact with other components of the mill to permit curing of the coating. Otherwise a portion of the coating might be wiped off denying that portion of the tubing adequate corrosion protection or making the tubing unsightly. Thus it is necessary to keep the tubing in the area of the coating station under considerable tension to limit its sagging so that the heating and blowing steps of the curing process can be carried out without contact to the tubing.

The components of the feed closure, welding, sizing, coating and helper stations are well known to those of skill in the continuous roll forming mill art. Additionally, the components of the embossing station, similar to corrugation stations shown in FIG. 4 and FIG. 5 of U.S. Pat. Nos. 3,247,692 and 3,940,962, respectively, are well known to those of skill in the related art of manufacturing corrugated helically coiled and wound pipes of thin sheet metal. Accordingly, in the interest of brevity, components of the stations need not be described further.

Figure 2:
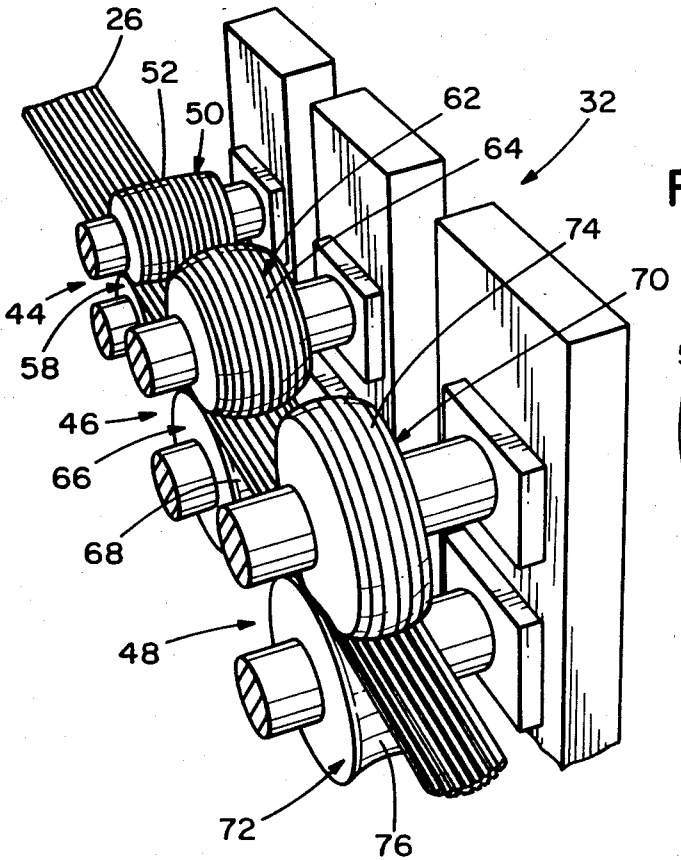
FIG. 2 is a perspective view of three pairs of rollers of the mill for sequentially increasing bending a metal strip from its flat condition.
Figure 4:
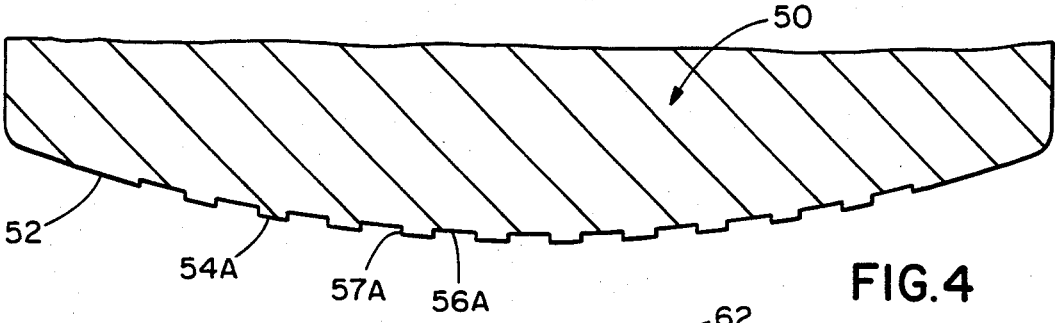
FIG. 4 is an enlarged partial sectional view illustrating the gripping surface of the upper roller of the first set of rollers.
Figure 5:
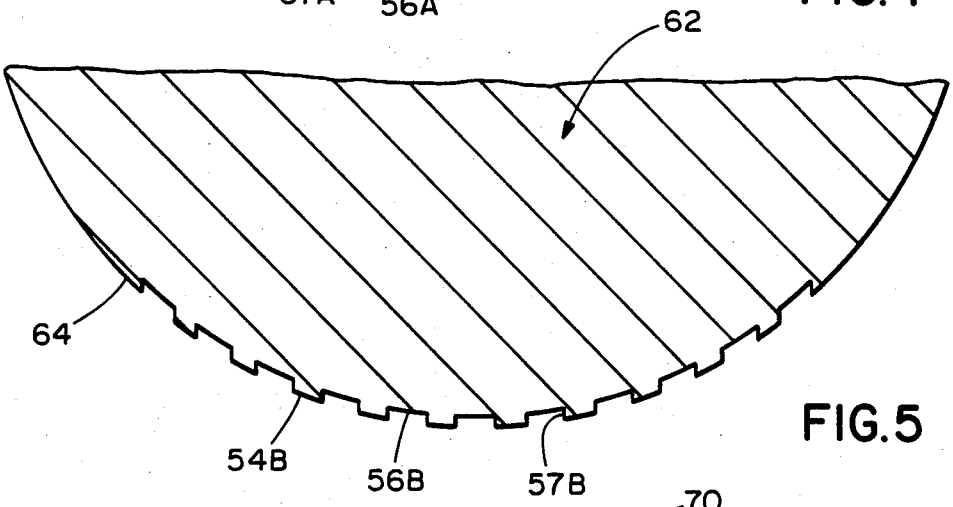
FIG. 5, similar to FIG. 4, shows the gripping surface of the upper roller of the second set of rollers.

Referring to FIG. 2, the breakdown station 32 includes three spaced pairs 44, 46 and 48 of rollers rotatably mounted on supports. The first pair 44, nearest the feed station 24, includes an upper roller 50 having a gripping surface 52, convex in transverse section as best shown in FIG. 4, having alternating high portions and low portions formed by annular ribs 54A and annular grooves 56A. Adjacent ribs and grooves are spaced and partially defined by vertical walls 57A. The gripping surface is shaped to mate or mesh with the facing surface of the fluted strip. That is, with the strip bent to the same arcuate configuration as that of the gripping surface 52, the ribs 54A and groove 56A of the gripping surface substantially match corresponding plateaus 29 and valleys 30 of the strip 26 as shown in FIG. 3. Also included in the first pair of rollers is a lower roller 58 having a smooth concave surface 60 facing gripping surface 52 and cooperating therewith firmly to compress the fluted strip therebetween. The intermediate roller pair 46 similarly comprises an upper roller 62 having a gripping surface 64, best shown in FIG. 5 provided with alternating ribs and grooves but having a greater degree of transverse curvature than gripping surface 52. The roller pair 46 also includes a roller 66 having a smooth concave facing surface 68 having a curvature complementary to that of intermediate gripping surface 64.

Figure 6:
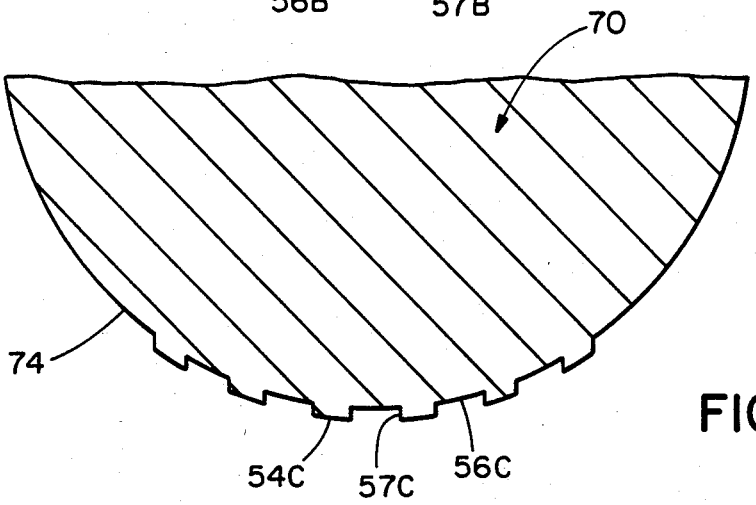
FIG. 6, also similar to FIG. 4, depicts the gripping surface of the upper roller of the third set of rollers.

The third pair of rollers 48 at the breakdown station 32 also includes an upper roller 70 and a lower roller 72 with the upper roller having a convex gripping surface 74 with alternating ribs 54C and grooves 56C spaced by vertical walls 57C and having a still greater degree of curvature as shown in FIG. 6. The lower roller similarly is provided with a smooth concave facing surface 76 for cooperating with gripping surface 74 to compressively hold the strip 26 therebetween. Due to the progressively greater curvature of gripping surfaces 52, 64, 74 and their corresponding facing surfaces 60, 68, 76; the three spaced pairs 44, 46, 48 of rollers function to sequentially transversely bend the strip 26 from its planar condition. As shown in FIGS. 4–6, the upper rollers having the gripping surfaces with the greatest curvature may have a reduced number of plateaus and valleys. Furthermore, the outer plateaus and valleys preferably have progressively decreased width measured with respect to the centerline of the roller, to match the shape of the strip after more extensive transverse bending. Additionally, the length of the vertical walls 57 preferably becomes larger with increased distance from the centerline of their corresponding rollers. While the breakdown station has been discussed as including three pairs of rollers, it will be appreciated that this is only by way of illustration. A particular application may optimally require a greater number of roller pairs or a lesser number may be adequate.

The rollers at the breakdown station are particularly useful for cooperating with the pinch rollers of the helper station 42 to tension the tubing, because the breakdown station 32 is the last location in the mill 20 where both sides of the strip are available for engagement by opposing rollers. After the breakdown station, opposing rollers are able to engage only the outside tubing surface. And the degree of compression must be limited to avoid collapse of the tubing or a reduction in its cross-sectional dimensions.

The use of conventional upper rollers in the breakdown station, having smooth arcuate working surfaces, has proved unsuccessful. The passage of the undulating strip between rollers having smooth working surfaces, and adjustment of the rollers to applying sufficient compressive forces so that they work against the pinch rollers to keep the tubing taut, has resulted in flattening of the fluted strip. Even if the somewhat flattened pattern was acceptable, the use of conventional roller pairs results in increased power consumption because work is performed in their partially undoing of the fluted pattern applied to the strip at the embossing station.

Operation of the roll forming tube mill 20 of the present invention is as follows: After the strip 26 and fluted tubing 22 resulting therefrom are initially threaded through the roller pair at the various stations, the roller pairs 44, 46, 48 are adjusted to cooperate with the pinch rolls at the helper station 42 to keep the tubing sufficiently taut that proper curing of the coating or coatings applied to the outside surface of the tubing can take place. Thereafter the various drives for the several pairs of driven rollers are simultaneously gradually brought up to operating speed.

As a method, the present invention includes several steps:

(A) Alternating high and low longitudinally extending portions are embossed on the surface of the strip to become the outside surface of the fluted tube.

(B) The strip is sequentially transversely bent from its planar condition by applying pressure to opposed sides of the strip without substantial flattening of the fluted pattern.

(C) The lateral ends of the bent portion of the strip are brought into abutment.

(D) The lateral ends are welded together.

In view of the above, it will be seen that the several objects of the invention are achieved and other advantageous results attained.

As various changes could be made without departing from the scope of the invention, it is intended that all matter contained in the above description shall be interpreted as illustrative and not in a limiting sense.

What is claimed is:

1. A tubing mill for roll forming a strip of metal into a fluted tube having alternating, longitudinally extending, substantially continuous high and low portions on its outside surface, said mill comprising:

feed means for supplying a generally planar strip of metal;

embossing means for forming said high and low portions on both the surface of said strip to be formed into the outside surface of said tube and the surface of the strip to be formed into the inside surface of said tube;

breakdown means for sequentially transversely bending said strip from its generally planar condition, said breakdown means comprising roller means having a gripping surface for engaging one of said surfaces of said strip and having alternating high and low portions shaped to mate with those of said strip so that the high and low portions of said gripping surface make substantially full surface contact with their corresponding high and low portions on said one surface of said strip;

closure means for bringing together the lateral sides of the bent portion of said strip;

welding means for welding said lateral sides together; and coating means for applying a coating to the outside surface of the welded tube, said mill further comprising downstream of said coating means a means for applying tension to said tube whereby said breakdown means and said means for applying tension cooperate to prevent substantial sagging of the tube therebetween.

2. A mill as set forth in claim 1 wherein said high portions comprise plateaus and said low portions comprise valleys.

3. A mill as set forth in claim 1 wherein said roller means comprises a first pair of rollers including a first roller having said gripping surface and a second roller having a working surface facing said gripping surface with said strip compressed between said gripping surface and the facing surface.

4. A mill as set forth in claim 3 wherein said gripping surface is convex and said facing surface is concave.

5. A mill as set forth in claim 3 wherein said roller means comprises a plurality of pairs of rollers with each pair having a first roller with a gripping surface with alternating longitudinal high and low portions, and a second roller having a generally smooth concave facing surface.

6. A mill as set forth in claim 5 wherein each successive first roller, further downstream of said feed means, has a gripping surface with a greater degree of curvature.

* * * * *